United States Patent [19]

Kron et al.

[11] 4,024,782

[45] May 24, 1977

[54] APPARATUS FOR CUTTING THE TRAILING END OF AN EXPIRING WEB

[75] Inventors: Martin W. Kron; Victor I. Polz, both of Rochester, N.Y.

[73] Assignee: Eastman Kodak Company, Rochester, N.Y.

[22] Filed: June 27, 1975

[21] Appl. No.: 590,898

Related U.S. Application Data

[62] Division of Ser. No. 456,484, April 1, 1974, Pat. No. 3,915,399.

[52] U.S. Cl. ..... 83/373; 83/430; 83/439; 83/441; 242/56 A

[51] Int. Cl.[2] ..... B26D 5/02

[58] Field of Search ..... 83/373, 430, 439, 441, 83/424; 242/56 R, 56 A, 56 B, 58.5

[56] References Cited

UNITED STATES PATENTS

| | | | |
|---|---|---|---|
| 2,785,749 | 3/1957 | Wilson et al. | 83/430 X |
| 2,787,427 | 4/1957 | Marczincsin | 242/56 A |
| 3,507,178 | 4/1970 | Lamon et al. | 83/373 X |
| 3,552,249 | 1/1971 | Purley et al. | 83/424 X |
| 3,752,412 | 8/1973 | Byrt | 242/56 A |
| 3,756,526 | 9/1973 | Bassett et al. | 242/56 R |

*Primary Examiner*—Frank T. Yost
*Attorney, Agent, or Firm*—S. W. Gremban

[57] ABSTRACT

An apparatus is disclosed for splicing the trailing end of an expiring web of an old stock roll to the leading web end of a new stock roll. The new stock roll is provided with a splicing tape for initially releasably attaching the leading end of the new stock roll to its outer web convolution. A plurality of sensors are provided for positioning the new stock roll and splicing tape in a precise presplicing position prior to the splicing operation. During the splicing operation, a web guiding and severing mechanism guides the expiring web into engagement with the new stock roll, severs the expiring web, and splices the trailing end of the expiring web to the splicing tape on the leading end of the new stock roll.

3 Claims, 15 Drawing Figures

APPARATUS FOR CUTTING THE TRAILING END OF AN EXPIRING WEB

This is a division of U.S. application Ser. No. 456,484 filed Apr. 1, 1974, now U.S. Pat. No. 3,915,399.

BACKGROUND OF THE INVENTION

1. Field of the Invention

This invention relates generally to splicing, and more specifically to an apparatus for splicing the trailing end of an expiring web to the leading end of a new stock roll.

3. Description of the Prior Art

Apparatuses and methods for splicing the trailing end of an expiring web to the leading end of a new web stock roll are generally well known in the art. For example, U.S. Pat. No. 2,149,832 discloses an apparatus and method in which the new stock roll is rotatably driven by an endless belt prior to the splicing operation to bring the rotational speed of the stock roll up to the speed of the expiring web. When the speeds are substantially equal, the new stock roll is moved into pressure engagement with a pressure roller over which the expiring web is trained. A paster on the new stock roll is provided with an adhesive on its inner surface for releasably holding the leading end of the stock roll to the adjacent web convolution. The paster is provided with adhesive on the outer surface thereof which adheres to the expiring web as the paster is moved through the nip formed by the pressure roller and new stock roll. The paster rips away from the adjacent convolution by virtue of a weakened section, thereby releasing the leading end of the new stock roll from the adjacent web convolution. One disadvantage of this splicing apparatus and method is that a plurality of separate drive belts must be provided to drive the new stock roll. In addition, the pasters have to be manually applied to the new stock roll which is time consuming. Another disadvantage is that the paster does not always rip along the weakened section and hence a portion thereof will remain on the stock roll. Consequently, one or more convolutions of the new stock roll are damaged by the paster portion before sufficient convolutions are wound on the portion to cover it and prevent damage to successive convolutions.

Another apparatus and method for splicing the trailing end of an expiring web to the leading end of a new stock roll is disclosed in U.S. Pat. No. 2,646,938. In this patent, the leading end of the new stock roll is V-shaped, and the tip thereof is secured to the adjacent web convolution by a pair of adhesive tabs. The edges of the remainder of the V-shaped leading end are provided with an adhesive. In addition, below the ends of the adhesive tabs are a pair of tear directing strips with adhesive thereon. The strips are positioned at an angle to the edges of the leading end with the inner tear strip ends situated inwardly and below the ends of the adhesive tabs. To achieve a splice, the expiring web is moved into low pressure engagement with the periphery of the new stock roll for initiating rotation of the new stock roll without adhering to the adhesive. When the stock roll is brought up to a predetermined speed, the splice is initiated by moving a brush which urges the expiring web into high pressure engagement with the periphery of the new stock roll. Accordingly, the adhesive and tear strips adhere to the expiring web and are torn away from the outer convolution of the stock roll and carried along the expiring web. The adhesive tabs remain on the web convolution. One disadvantage of this splicing apparatus is that it is difficult for the expiring web to rotatably drive the new stock roll without prematurely adhering the expiring web to the adhesive on the leading end of the new stock roll. In addition, a portion of the web end remains on the adjacent web convolution resulting in wastage of at least one web convolution. In addition, the adhesive tabs, adhesive and adhesive tear strips have to be manually applied to the web end which is tedious and time consuming.

Another web splicing apparatus for splicing the trailing end of an expiring web to the leading end of a new web roll is disclosed in U.S. Pat. No. 3,198,452. In this apparatus, the edge of the leading end of the new web roll is provided with adhesive along the entire width of the web except for a small section. Through this section an endless drive belt engages the web roll for rotatably driving the roll. The leading end of the web in this small section is provided with a splicing tape having raised non-adhesive strips thereon engageable by the drive belt. When the roll reaches a desired speed, a brush is actuated pushing the expiring web against the periphery of the new web roll and into pressure engagement with the adhesive and splicing tape. Once again, the disadvantage of this apparatus is that the adhesive and splicing tape has to be manually applied to the end of the web roll which is tedious and time consuming. In addition, a special web roll driving mechanism is required to drive the web roll. Applicant's improved apparatus and method for splicing the trailing end of an expiring web to the leading end of a new web roll is believed to obviate these and other disadvantages of known prior art web splicing apparatuses and methods.

SUMMARY OF THE INVENTION

In accordance with a preferred embodiment of the invention, an improved web splicing apparatus is disclosed for splicing the trailing end of an expiring web to the leading end of a new web stock roll. The web splicing apparatus comprises a web guiding and severing mechanism having web guiding means including a pair of spaced members such as rollers for guiding an expiring web trained over the members along a predetermined path. The web guiding and severing mechanism further comprises severing means for severing the expiring web between the spaced members. More specifically, the spaced members comprise parallel cantilevered rollers which are movable as a unit axially thereof from a retracted position, in which the rollers are out of alignment with the expiring web, to an extended position in which the rollers straddle the expiring web. The rollers are then rotatable as a unit through an angle while in the extended position to a guiding position for engaging and guiding the expiring web along a substantially S-shaped path. The rollers are laterally movable in the guiding position causing one of the rollers to engage the periphery of the new web roll for urging the expiring web into pressure engagement with the periphery of the new web roll.

A method for splicing the trailing end of an expiring web to the leading end of a new web roll utilizing the web splicing apparatus of this invention comprises initially positioning a new web roll in a stationary presplicing position. The moving expiring web is guided over a pair of spaced guide members forming a curved web loop spaced from the periphery of the new web roll. The web roll and the guide members are moved relative to one another for urging at least one of the guide members and the expiring web into pressure engagement with the periphery of the new web roll. The expiring web is severed between the spaced guide members, and the trailing end of the expiring web is pressed by the guide member in engagement with the new web roll into pressure engagement with an adhesive on the outer surface of the leading end for splicing the leading and trailing web ends together. The curved web loop formed by the spaced guide members is preferably an S-shaped loop. In the automatic splicing mode of operation, the positioning step includes imparting lateral movement to the new web roll, and stopping the lateral movement when a sensor senses the periphery of the new web roll at the presplicing position. The positioning step further includes the step of imparting axial movement to the new web roll, and stopping axial movement thereof when a sensor senses alignment of the roll end surface and an edge of the expiring web. The positioning step further includes the step of imparting rotational movement to the new web roll while in the presplicing position, and stopping rotational movement thereof when a sensor senses the leading end of the new web.

The apparatus and method of this invention further utilizes a new and improved splicing tape comprising a ribbon having adhesive on each side thereof, and cover sheets covering the adhesive on each side of the ribbon. One of the cover sheets comprises a strip of metallic foil to which one of the sensors is responsive, and is provided with a plurality of perforations along an edge thereof through which the adhesive is exposed. the other cover sheet comprises two abutting paper strips.

One of the objects and advantages of this invention is to provide an improved apparatus and method for splicing the trailing end of an expiring web to the leading end of a new web roll. The improved apparatus comprises a unitary web guiding mechanism for guiding the expiring web along a path to form a curved loop in position to be severed.

Another object and advantage of the invention is to provide an improved web splicing apparatus for splicing the trailing end of an expiring web to the leading end of a new web roll. The splicing apparatus comprises a web guiding mechanism for guiding the expiring web along a path forming a curved S-shaped loop, and a severing mechanism supported by the guiding mechanism for severing the expiring web at substantially the center of the loop.

Another object and advantage of the present invention is to provide an improved splicing tape having an adhesive coating which is partially covered by a perforated foil on one side for adhering with a predetermined strength the leading end of the new web roll to the outer convolution, and a similar adhesive which forms a larger area of bonding of greater strength on the other side for adhering the leading end to the trailing end of the expiring web.

Another object and advantage of the present invention is to provide an apparatus and method for splicing the trailing end of an expiring web to the leading end of a new web roll that is of simple design and construction, thoroughly reliable and efficient in operation, and economical to manufacture.

The invention and its objects and advantages will be come more apparent from the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Because web unwind stands and related equipment are well known, the present description will be directed to elements forming part of, or cooperating more directly with, apparatus in accordance with the present invention. Elements of web unwind stands and equipment not specifically shown or described are understood to be selectable from those known in the art.

Figure 1:
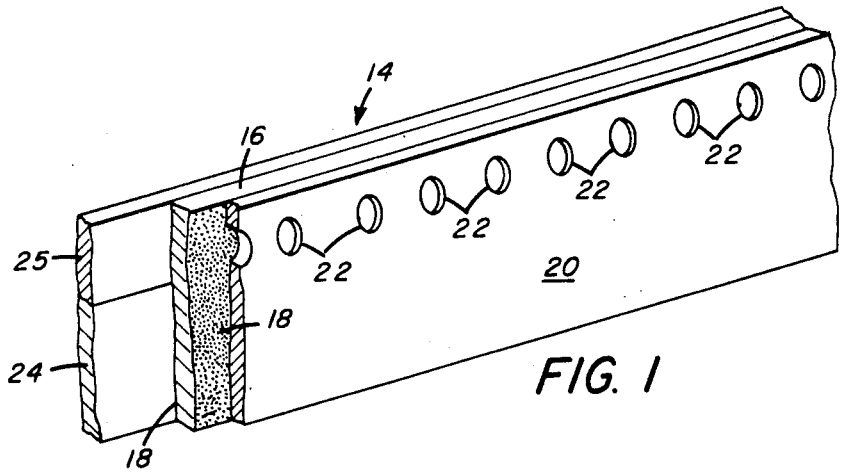
FIG. 1 is a segmental view in perspective of a splicing tape with end portions broken away.
Figure 2:
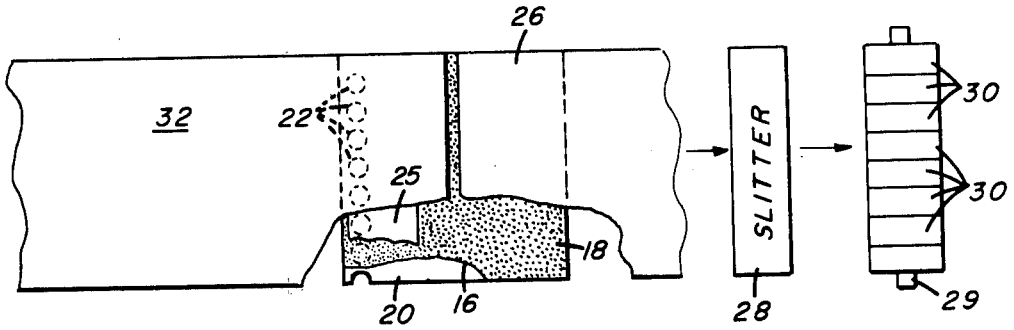
FIG. 2 is a top plan view of the splicing tape of FIG. 1 with a portion broken away illustrating how it is used to thread the leading end of a new stock roll through the slitter to form slit stock rolls.
Figure 3:
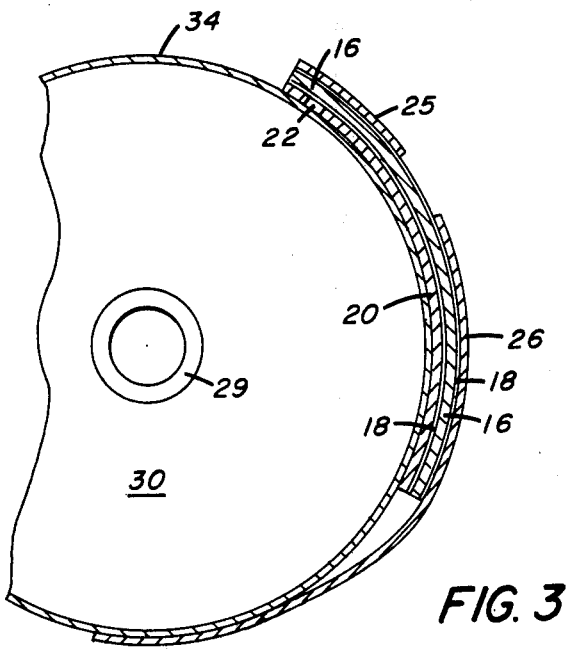
FIG. 3 is an end view of a slit stock roll of FIG. 2 with a leading end of the web enlarged and in section.

The apparatus and method of the invention for splicing an expiring web to a new web roll utilizes a new and improved splicing tape 14 for the new web roll. The splicing tape 14 as best illustrated in FIG. 1 comprises a central ribbon 16 having adhesive 18 on each side. A metallic foil strip 20 covers the adhesive on one side of ribbon 16 and is provided with a plurality of perforations 22 along one edge. Abutting backing paper strips 24, 25 cover the adhesive 18 on the other side of ribbon 16. The splicing tape 14 is initially used in a web slitting operation as best illustrated in FIG. 2 in which a large width web 26 from a roll is fed through a slitter 28 onto a core 29 to form a plurality of new slit stock rolls 30 of narrower width of the type used in the present invention. The splicing tape 14 of this invention is initially used to attach the leading end of a new web 32 to the trailing end of old web 26 for threading the leading end through slitter 28. To achieve this, backing paper strip 24 is removed from splicing tape 14 and the splicing tape secured to the under side of the leading and trailing ends of webs 26, 32 as best illustrated in FIG. 2. Accordingly, when the trailing end of web 26 passes through slitter 28, the leading end of new web 32 and the splicing tape 14 is slit along with the webs to the precise width of the slit stock rolls 30. As soon as the leading end of a new web 32 is threaded through slitter 28, the leading end is removed from splicing tape 14. The trailing end of web 26 along with tape 14 is wound on the slit rolls 30 as illustrated in FIG. 3. When splicing tape 14 is pressed against the outer roll convolution 34, the adhesive 18 extends through the perforations 22 in foil 20 for releasably securing the trailing end of web 26 to the outer roll convolution. The new slit stock rolls 30 are removed from slitter 28 and transferred to the web unwind stand. The remaining cover strip 25 is removed from splicing tape 14 of each roll 30 to prepare the roll and splicing tape for a splicing operation.

Figure 4:
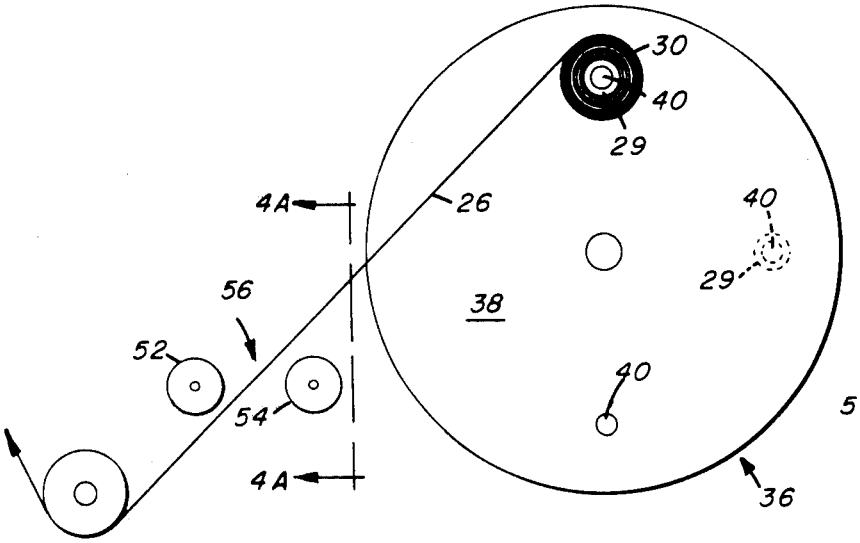
FIG. 4 is a schematic view of a web stock roll unwind stand in which the web is nearing the end of the old stock roll.
Figure 5:
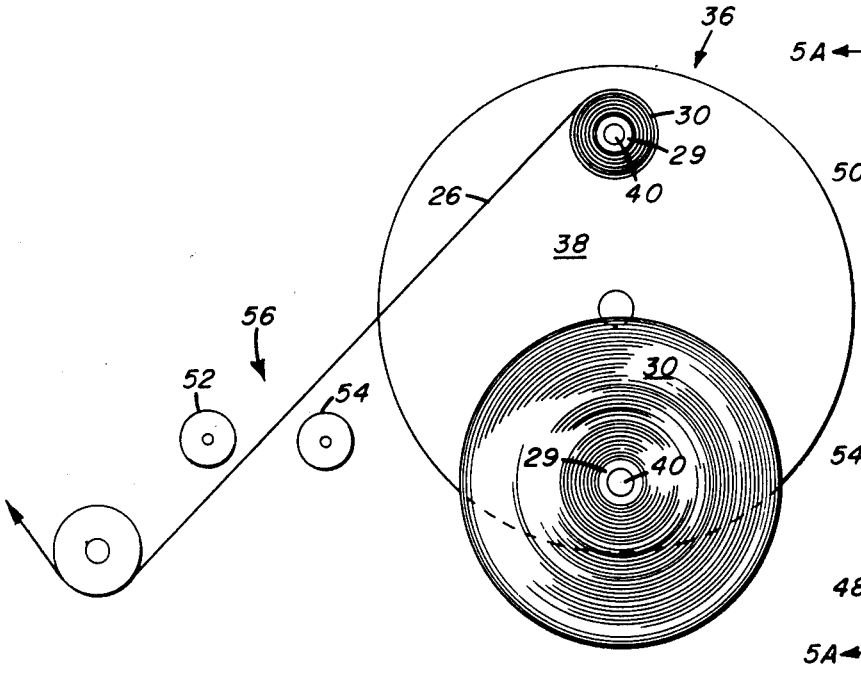
FIG. 5 is a view similar to FIG. 4 showing the unwind stand with a new stock roll mounted thereon.
Figure 6:
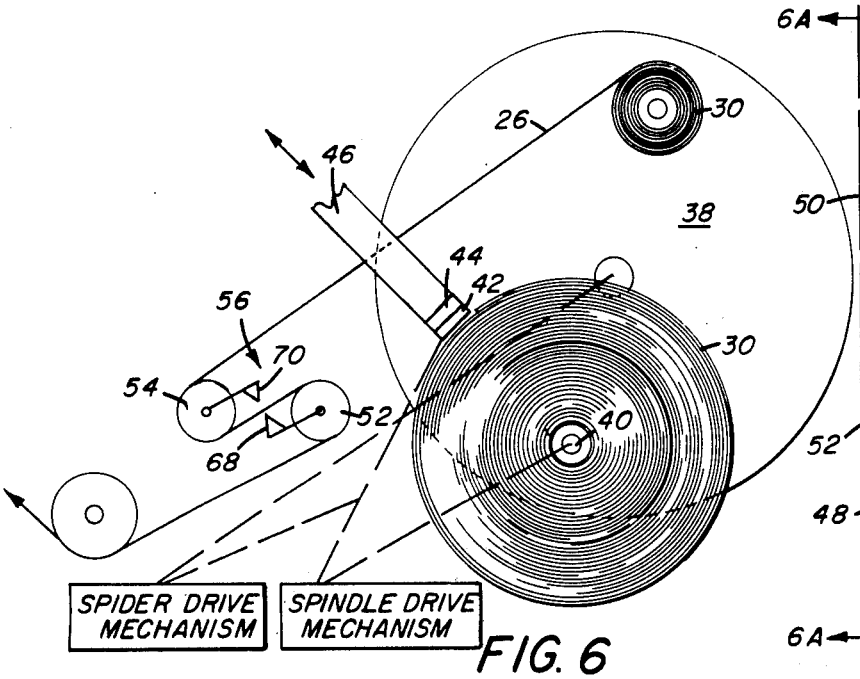
FIG. 6 is a view similar to the previous views showing the unwind stand rotated through a small angle in a clockwise direction to laterally position the new stock roll in a presplicing position, and the web guiding and severing mechanism rotated in a counterclockwise direction through an angle of approximately 180° to guide the web into an S-shaped loop.

With reference to the drawings, a web unwind stand 36 is illustrated of the general type disclosed in U.S. Pat. Nos. 2,149,832 and 3,198,452. The web unwind stand 36 generally comprises a rotatable spider 38 having a pair of diametrically opposed spindles 40 for receiving web stock rolls 30. The unwind stand has a load station (FIG. 4) at which a new stock roll 30 is mounted on a spindle 40 (FIG. 5) an unwind station at which a web 26 is unwound from a previously loaded stock roll 30 and fed to any suitable web take-up or web converting device, and an unload station at which the stock roll core 29 is unloaded from the unwind stand. The unwind stand 36 is normally provided with a drive mechanism of known type, not shown, for rotatably driving the spider 38 in a clockwise direction, and means for stopping the spider with spindles 40 at the various stations. Normally in such unwind stands, a new stock roll 30 is loaded onto spindle 40 at the load station while a web 26 is being removed from a stock roll 30, at the unwind station. As the unwound web nears the end of stock roll 30, the spider 38 is rotated through a small angle to position a new stock roll 30 in a presplicing position as seen in FIG. 6.

Figure 5A:
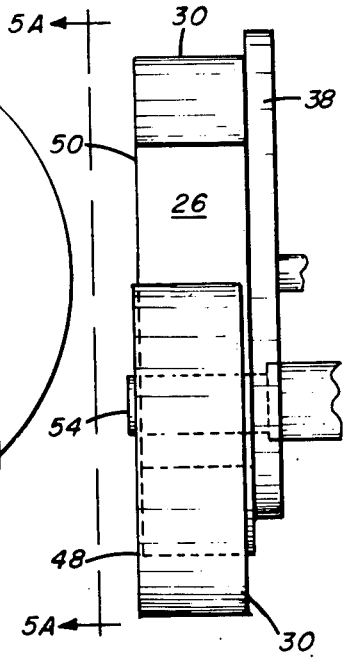
FIG. 5A is a left side elevational view of the unwind stand of FIG. 5 taken substantially from line 5A—5A of FIG. 5 showing the web guiding and severing mechanism in its extended position with the end surface of the new stock roll out of alignment with an edge of the expiring web.
Figure 6A:
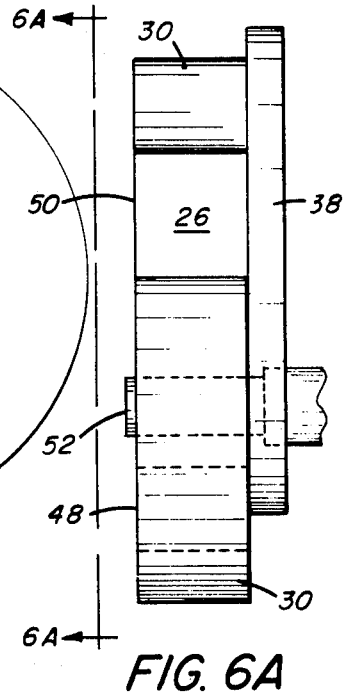
FIG. 6A is a left side elevational view of the unwind stand of FIG. 6 taken substantially from line 6A—6A of FIG. 6 showing the end surface of the new stock roll aligned with the edge of the expiring web.
Figure 7:
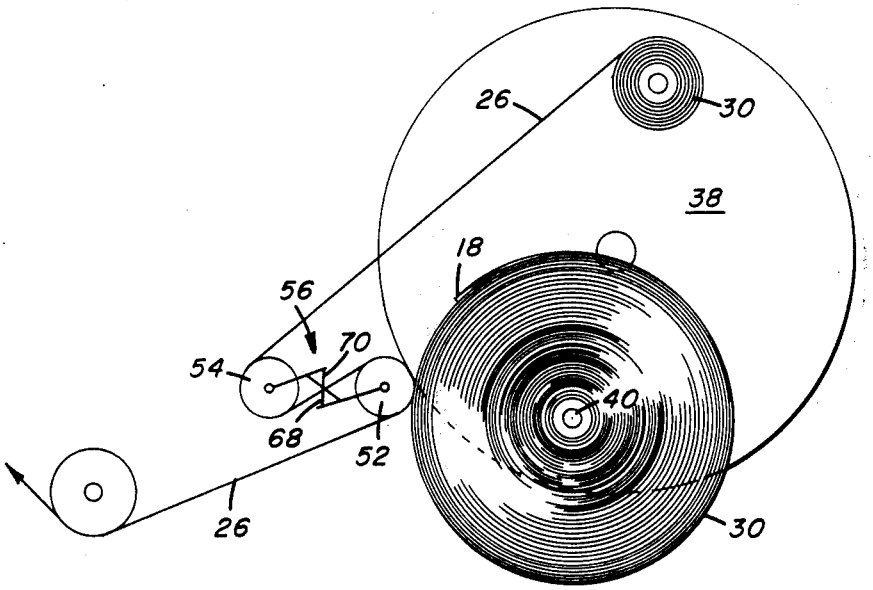
FIG. 7 is a view similar to FIG. 6 showing the web guiding and severing mechanism moved laterally until one of the rollers presses the expiring web into engagement with the periphery of the new stock roll.

The web splicing apparatus of this invention is provided with novel means for precisely positioning a new stock roll 30 at the presplicing position. Such novel means comprises three spaced sensing means 42 of known type such as photocell, fluidic or magnetic sensors mounted on a bracket 44 at one end of a reciprocally movable arm 46. The arm 46 is movable from a retracted position in which the sensing means are clear of spider 38 and rolls 30, to a sensing position in which the sensing means 42 are positioned to be responsive to a new stock roll 30. A first sensor of sensing means 42 is adapted when in the sensing position to sense the aproaching periphery of new stock roll 30 as it is moved laterally (FIG. 6). The first sensor actuates the spider drive mechanism to stop the rotation of spider 38 when new stock roll 30 reaches its presplicing position. The new stock roll 30 is rotatably driven while in the presplicing position by any suitable spindle drive mechanism, shown in block form, and a second sensor of sensing means 42 senses the leading edge of metallic foil strip 20 of splicing tape 14 on the new web roll. The second sensor inactivates the spindle drive mechanism, shown in block form, for halting the rotation of the new stock roll 30 when the metallic edge is sensed to accurately position the splicing tape 14 relative to the expiring web 26. A third sensor of sensing means 42 senses the alignment at the presplicing position of an end surface 48 (FIG. 5A) of the new stock roll 30 with an edge 50 of expiring web 26. If the two are not in proper alignment as illustrated in FIG. 5A, any suitable spindle drive mechanism of known type, also represented in block form, is actuated by the third sensor for axially moving spindle 40 and new stock roll 30 until end surface 48 is in alignment with the web edge 50 as illustrated in FIG. 6A. During positioning of new stock roll 30 in the presplicing position, a pair of guide rollers 52, 54 of a web guiding and severing mechanism 56 to be described later guides the expiring web 26 into a substantially S-shaped loop as illustrated in FIG. 6. When it is desired to splice the expiring web 26 to the new web stock roll 30, a splicing operation is initiated in which the web guiding and severing mechanism 52 is moved laterally by mechanism to be described later moving guide roller 52 into engagement with the periphery of the new stock roll 30 as illustrated in FIG. 7. Substantially simultaneously, a severing mechanism to be described later is actuated for severing the expiring web 26. The trailing end of expiring web 26 and the leading end of the new stock roll 30 with splicing tape 14 attached thereto are fed into the nip of guide roller 52 and stock roll 30 for splicing the trailing end of the expiring web 26 to the leading end of the new stock roll.

Figure 8:
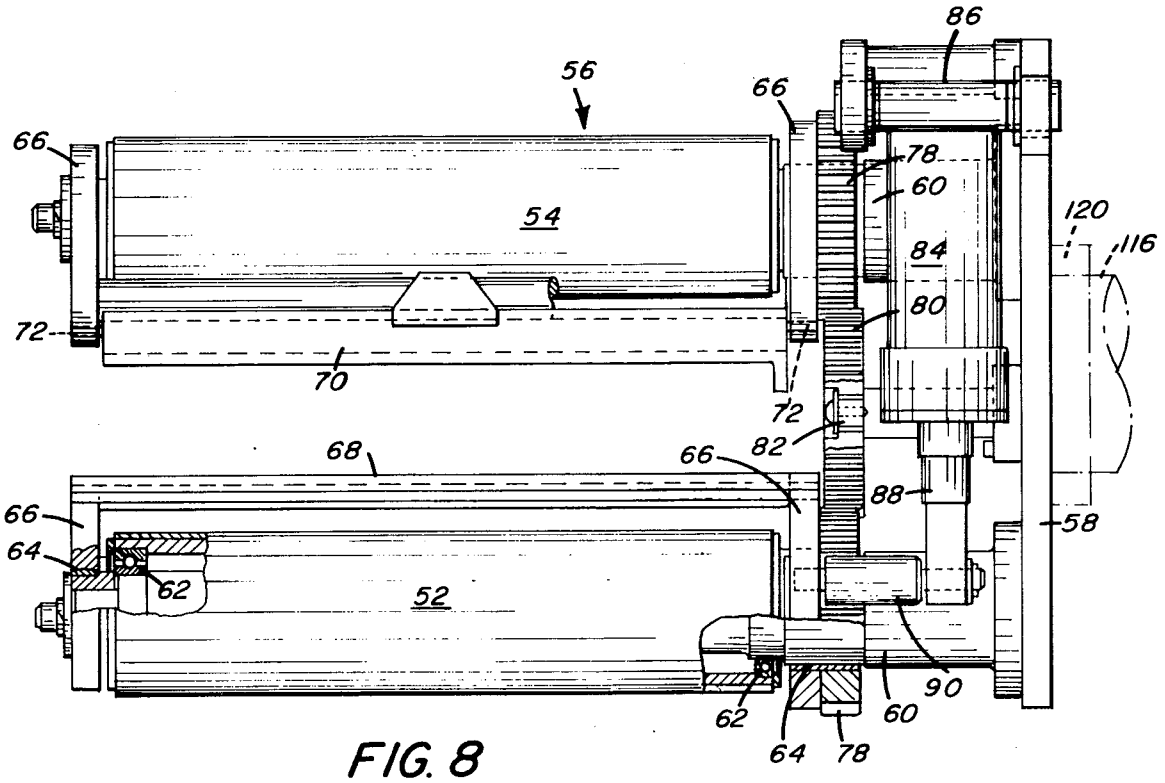
FIG. 8 is a side elevational view of the rollers and severing mechanism of the web guiding and severing mechanism.
Figure 9:
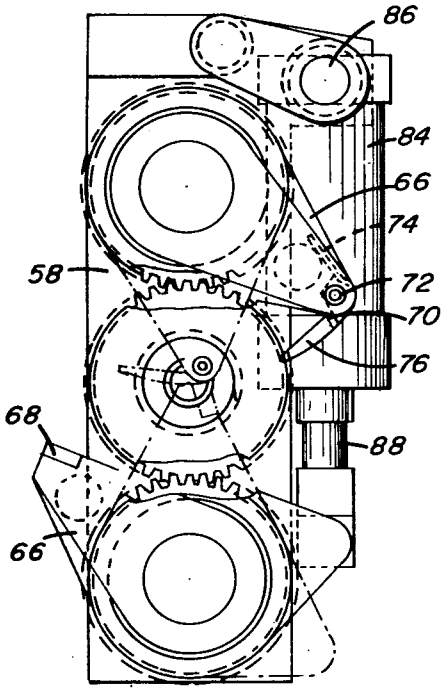
FIG. 9 is a left end elevational view of the mechanism of FIG. 8.
Figure 10:
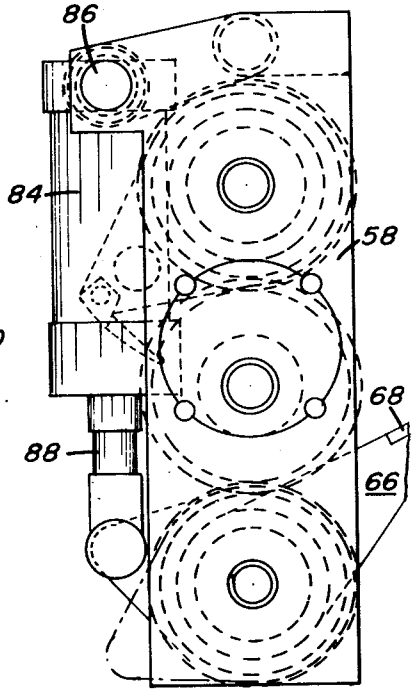
FIG. 10 is a right end elevational view of the mechanism of FIG. 8.

With reference to FIGS. 8–10, the web guiding and severing mechanism 56 is disclosed comprising a mounting plate 58 having a pair of parallel laterally extending spindles 60 rigidly secured at one end to the mounting plate. Each of the spindles 60 has ball bearings 62 mounted thereon (FIG. 8) for rotatably supporting idler guide rollers 52, 54. Each of the spindles 60 is further provided adjacent the ends of rollers 52, 54 with sleeve bearings 64 mounted thereon for rotatably supporting knife blade arms 66. One pair of arms 66 support a knife blade 68 which is rigidly secured to the ends of arms 66, and the other pair of arms 66 pivotally support a knife blade 70 on stub shafts 72. The pivotal blade 70 is urged by a spring 74 (FIG. 9) toward knife blade 68 and against an adjustable stop, not shown. The pivotal blade 70 has a depending finger 76 adapted to engage the edge of fixed knife blade 68 during a severing operation for guiding blade 70 into shearing engagement with the edge of knife blade 68 as best illustrated by broken lines in FIG. 9. The knife blades 68, 70 are movable by a drive mechanism between a retracted position in which the blades are open to permit passage of a web therethrough, and a cutting position for severing the web. The drive mechanism comprises a gear train in which a pair of gears 78 are rotatably mounted on sleeve bearings 64 and rigidly secured by any suitable means to the adjacent knife arm 66. An idler gear 80 is interposed between and in meshing engagement with gears 78, and is rotatably mounted on a bearing supported by a stub shaft 82 having one end secured to mounting plate 58. The gears 78, 80 and blades 68, 70 are movable by a fluid cylinder 84 having one end pivotally mounted on a pin 86 supported by mounting plate 58. A reciprocally movable cylinder rod 88 at the opposite end of cylinder 84 is secured to an arm 66 of knife blade 68 by a connecting rod 90, one end of which is fixed to knife arm 66 and the opposite end journaled through a bearing in the end of cylinder rod 88. Accordingly, with the cylinder rod 88 in its retracted position as illustrated in FIG. 9, the knife blades 68, 70 are in an open position. When cylinder 84 is actuated by any suitable switch and air valve, the rod 88 is moved to its extended position as seen dotted in FIG. 9 for moving knife blades 68, 70 together causing the engaging shearing edges thereof to sever a web 26 interposed therebetween.

Figure 11:
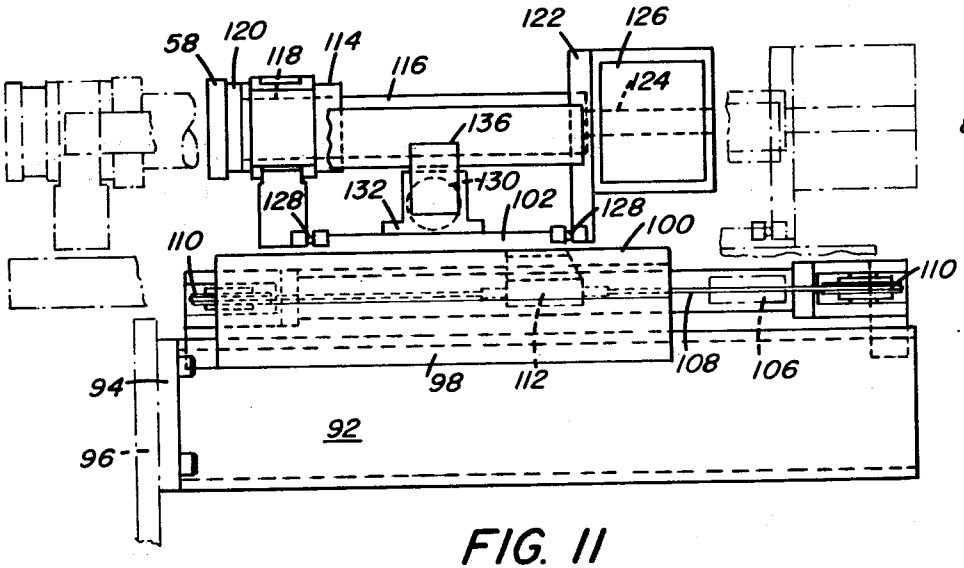
FIG. 11 is a side elevational view of the drive mechanism for the web guiding and severing mechanism of FIG. 8.
Figure 12:
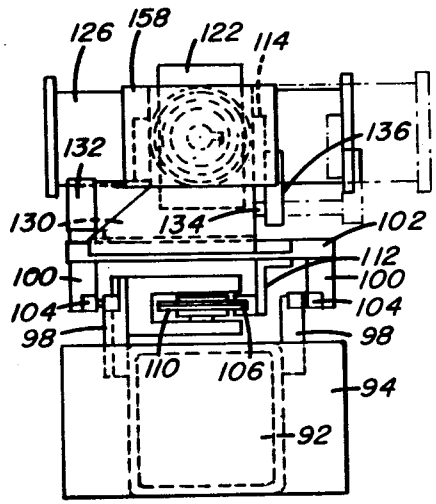
FIG. 12 is a left end elevational view of the drive mechanism of FIG. 11.

The mechanisms for supporting and moving the web guiding and severing mechanism 56 in a first direction axially of rollers 52, 54, in a second direction rotationally of rollers 52, 54 and a third direction laterally of rollers 52, 54 will now be described with reference to FIGS. 11 and 12. The supporting mechanism comprises a hollow beam 92 of square-shaped cross section having one end secured to a holding plate 94 which is in turn secured to a rigid support frame 96 by any suitable means. Upwardly extending side plates 98 (FIG. 12) are secured by welding or the like to each side of beam 92, and depending plates 100 are secured to a carriage plate 102 above beam 92. Interposed between the ends of plates 98, 100 are elongated guideways 104 for slidably supporting carriage plate 102 for reciprocal movement back and forth along the guideways. Movement is imparted to carriage plate 102 by a cable air cylinder 106 of known type mounted on one of the side plates 98 and having a cable 108 trained around pulleys 110 and secured to a bracket 112 which is in turn secured to carriage plate 102. Reciprocal movement of carriage plate 102 results in corresponding movement of a housing 114 on the carriage. A support shaft 116 is journaled in a bearing 118 supported by the housing. The mounting plate 58 of the web guiding and severing mechanism 56 is secured by bolts or the like to a flange 120 secured to one end of support shaft 116. Movement of carriage 102 moves the web guiding and severing mechanism 56 in an axial direction between a retracted position in which guide rollers 52, 54 are clear of the expiring web 26 (FIG. 4A) and an extended position in which the guide rollers straddle the web (FIG. 5A).

The end of support shaft 116 opposite flange 120 extends through an opening in a side frame 122 of housing 114 and has a necked-down cylindrical end 124 extending into a rotary air actuator 126 secured to the side frame. The rotary air actuator 126 is of a known commercial type capable of rotating support shaft 116 in clockwise and counter-clockwise directions through an angle of substantially 180°. The housing 114 including side frame 122 is further mounted on carriage plate 102 for lateral reciprocal movement by elongated slidable guideways 128 interposed between carriage plate 102 and housing 114. Lateral movement is imparted to housing 114 and support shaft 116 by an air cylinder 130 havine one end secured to a bracket 132 on carriage plate 102, and a cylinder rod 134 at the opposite end secured to a depending bracket 136 mounted on housing 114. Accordingly, actuation of cylinder 130 by any suitable switch and air valve arrangement imparts lateral reciprocal movement to housing 114 between the full line and broken line positions illustrated in FIG. 12. Such lateral movement of housing 114 and plate 58 causes guide roller 52 to be moved laterally to and from engagement with the periphery of new web roll 30 in its presplicing position (FIG. 7).

Figure 4A:
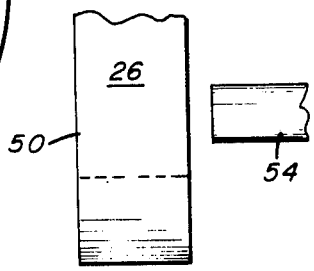
FIG. 4A is a side elevational view of the unwind stand of FIG. 4 taken substantially from line 4A—4Aof FIG. 4 showing the web guiding and severing mechanism in a retracted position.

When it is desired to splice the expiring end of a slit roll 30 to the leading end of a new slit roll, the spider 38 is rotated by any suitable drive mechanism and control until the first sensor of sensing means 42 senses the periphery of the new slit roll. When this occurs, further rotation of spider 38 is terminated. The slit roll is rotated by any suitable means and the second sensor positions the leading end of the new slit roll by sensing the metallic foil of the splicing tape adhering to the leading end and in response thereto terminating rotation of the roll. The third sensor senses the end surface 48 of the slit roll. If the end surface is not in alignment with the edge 50 of the expiring web as illustrated in FIG. 5A, a drive mechanism of any suitable type is actuated for axially moving the slit roll until the end surface 48 and the edge 50 are in alignment as illustrated in FIG. 6A. Accordingly, the new slit roll 30 is now in proper presplicing position. During the time that the new slit roll is being positioned in its presplicing position, the web guiding and severing mechanism 56 is moved axially of its rollers 52, 54 from its normal retracted position as seen in FIG. 4A to its extended position as seen in FIG. 5A in which rollers 52, 54 straddle the expiring web. The web guiding and severing mechanism 56 is then moved rotationally while in its extended position for engaging and guiding the web into an S-shaped loop as seen in FIG. 6. The splicing apparatus is now in position to carry out the splicing operation. Upon an appropriate signal from the operator or control system, the web guiding and severing mechanism 56 is moved laterally bringing roller 52 into pressure engagement with the periphery of the new web roll as seen in FIG. 7 for rotatably driving the roll. Substantially simultaneously air cylinder 84 is actuated for driving blades 68, 70 for severing the expiring web. The trailing end of the expiring web and splicing tape 14 on the new roll are drawn through the nip formed by roller 52 and roll 30 for splicing the trailing end to the uncovered adhesive surface 18 of the splicing tape. The splicing tape 14 which is only held to the outer convolution of the new roll by the exposed adhesive at the tape perforations 22 is readily separated from outer web convolution 34. The operation of spider 30, spindles 40, sensors 42, web guiding and severing mechanism 56, and other elements by the splicing apparatus is controlled in timed relation by any suitable mechanical and/or logic control system, not shown.

To effect a butt splice on a running web, the splice sequence is slightly altered. After the new web roll 30 and splicing tape 14 have been positioned properly, the new web roll is accelerated until its peripheral speed matches the expiring web speed. The splicing apparatus prepares for the splice with the lateral movement and the pinching of roller 52 and the expiring web against the new roll periphery immediately after the splicing tape 14 has passed by the web guiding and severing mechanism 56. The second sensor of sensing means 42 detects the succeeding passage of splicing tape 14 past the sensing means. It triggers actuation of blades 68, 70 and severing of the expiring web the instant the leading edge of the splicing tape passes under the sensing means. Since the expiring web is pinched against the periphery of new web roll 30, it engages the adhesive on splicing tape 14 and transports the new web through the machine. By locating the second sensor a distance from the pinch point which is equal to the length of the expiring web between the cutting blades 68, 70 and the pinch point, a butt splice will be effected.

The invention has been described in detail with particular reference to preferred embodiments, but it will be understood that variations and modifications can be effected within the spirit and scope of the invention as described.

We claim:

1. In a web severing mechanism for use in severing the trailing end of a moving expiring web which is spliced to the leading end of a new roll, the combination comprising:

a frame:

web guiding means comprising a pair of spaced apart parallel members cantilevered from said frame;

means for moving said frame from a retracted position in which said members are laterally spaced from said web to an extended position in which said members straddle said moving expiring web;

means for rotating said frame through an angle while in said extended position for moving said members to a guiding position for engaging and guiding said moving expiring web along a substantially S-shaped path to form a straight reach of web extending between said members; and means rotatably mounted on said members and cooperating together for severing said straight reach of web.

2. The invention according to claim 1 wherein said spaced members comprise rollers.

3. The invention according to claim 1 wherein said spaced members comprise a pair of parallel rollers having axes, and said severing means comprises a pair of knives rotatably mounted coaxially of said roller axes and adapted when moved together to sever said expiring web.

* * * * *